United States Patent [19]

Lauke et al.

[11] Patent Number: 4,935,332

[45] Date of Patent: Jun. 19, 1990

[54] PHOTOSENSITIVE ELEMENT HAVING AN ALUMINUM BASE AND SILANE INTERMEDIATE LAYER

[75] Inventors: Harald Lauke, Mannheim; Wilhelm Weber, Neustadt; Reinhold J. Leyrer; Bernhard Nick, both of Ludwigshafen; Thomas Loerzer, Frankenthal, all of Fed. Rep. of Germany

[73] Assignee: BASF Aktiengesellschaft, Ludwigshafen, Fed. Rep. of Germany

[21] Appl. No.: 376,922

[22] Filed: Jul. 10, 1989

Related U.S. Application Data

[63] Continuation of Ser. No. 64,539, Jun. 22, 1987, abandoned.

[30] Foreign Application Priority Data

Aug. 16, 1986 [DE] Fed. Rep. of Germany ..... 3627757

[51] Int. Cl.[5] ..... B03C 1/76

[52] U.S. Cl. ..... 430/272; 430/278; 430/300; 430/302; 430/306

[58] Field of Search ..... 430/272, 278, 300, 302, 430/306

[56] References Cited

U.S. PATENT DOCUMENTS

| | | | |
|---|---|---|---|
| 2,714,066 | 7/1955 | Jewett et al. | 430/278 |
| 3,181,461 | 9/1965 | Fromson | 430/278 |
| 3,276,868 | 10/1966 | Uhlig . | |
| 3,440,050 | 4/1969 | Chu . | |
| 3,520,683 | 7/1970 | Kerwin | 430/272 |
| 3,877,939 | 4/1975 | Okai | 430/278 |
| 3,902,976 | 9/1975 | Walls . | |
| 3,907,562 | 9/1975 | Crystal | 430/49 |
| 4,063,948 | 12/1977 | Lind | 430/83 |
| 4,066,453 | 1/1978 | Lind et al. | 430/49 |
| 4,153,461 | 5/1979 | Berghauser et al. . | |
| 4,405,702 | 9/1983 | Shirai | 430/60 |
| 4,439,509 | 3/1984 | Sclank | 430/67 X |
| 4,464,405 | 8/1984 | Teuscler | 430/60 X |
| 4,571,371 | 2/1986 | Yashiki | 430/60 X |
| 4,725,526 | 2/1988 | Frass et al. | 430/272 |
| 4,732,858 | 3/1988 | Brewer et al. | 430/272 |
| 4,782,000 | 11/1988 | Lauke et al. | 430/60 |

FOREIGN PATENT DOCUMENTS

| | | |
|---|---|---|
| 1300415 | 4/1971 | Fed. Rep. of Germany . |
| 1134093 | 4/1975 | Fed. Rep. of Germany . |
| 1621478 | 3/1976 | Fed. Rep. of Germany . |
| 2532769 | 3/1976 | Fed. Rep. of Germany . |
| 2323453 | 2/1978 | Fed. Rep. of Germany . |
| 2357871 | 12/1978 | Fed. Rep. of Germany . |
| 51-36138 | 3/1976 | Japan . |
| 1419643 | 12/1975 | United Kingdom . |
| 1444381 | 7/1976 | United Kingdom . |

*Primary Examiner*—Jack P. Brammer
*Attorney, Agent, or Firm*—Keil & Weinkauf

[57] ABSTRACT

A sensitized lithographic printing plate is produced from an aluminum base which has been mechanically, chemically and/or electrochemically pretreated and anodically oxidized in a conventional manner and a photosensitive copying layer which is applied to this base, by a process in which a thin layer which imparts hydrophilic properties and consists of a hydrolysis product or condensate of one or more silanes is applied between the base and the copying layer.

These lithographic printing plates are particularly useful for offset printing.

4 Claims, No Drawings

PHOTOSENSITIVE ELEMENT HAVING AN ALUMINUM BASE AND SILANE INTERMEDIATE LAYER

This application is a continuation of application Ser. No. 064,539, filed on June 22, 1987 now abandoned.

The present invention relates to a process for the production of sensitized lithographic printing plates from pretreated aluminum bases and photosensitive copying layers, an intermediate layer being applied between the base and the copying layer, and to the use of these lithographic printing plates for offset printing.

Offset printing plates generally consist of a base to which a radiation-sensitive reproduction layer is applied, with the aid of which an image is produced photomechanically from a transparency. After the production of the printing plate, the base supports the image areas which are ink-carrying during subsequent printing and at the same time forms the water-conveying background in the image-free areas.

Thus, the requirements which a base suitable for photosensitive material for the production of a printing plate has to meet are, on the one hand, that the printing image areas developed from the copying layer of the material adhere very firmly to it and, on the other hand, that the base constitutes a hydrophilic image background and its repellent action with respect to oleophilic printing inks is retained, meeting the requirements of the printing process. Consequently, the base must to a certain extent always have. a porous surface structure so that its surface can retain sufficient water in order adequately to repel the printing ink used in printing.

Aluminum, steel, copper, brass or zinc foils can be used as bases of photosensitive layers.

As a rule, aluminum and aluminum alloys are used for offset printing plates and are modified by a number of pretreatment steps in order to ensure good adhesion of the radiation-sensitive layer and hence long print runs.

For example, aluminum is mechanically, chemically and/or electrochemically roughened, if necessary subjected to intermediate pickling and anodically oxidized. The skilled worker is familiar with electrochemical roughening in HCl and/or $HNO_3$ and anodic oxidation in $H_2SO_4$ and/or $H_3PO_4$ as standard methods.

In the prior art, it is usual to subject such anodized bases to a further treatment step in order to improve adhesion of the layer, to increase the hydrophilicity or to facilitate development of the photosensitive copying layer. The patent literature describes, inter alia, methods such as silicatization (cf. for example German Laid-Open Application DOS 2,532,769 and U.S. Pat. No. 3,902,976) and treatment with complex fluorides (cf. for example German Published Application DAS 1,300,415 and U.S. Pat. No. 3,440,050) or with polyvinylphosphonic acid (cf. for example German Patent Nos. 1,134,093 and 1,621,478 and U.S. Pat. Nos. 3,276,868 and 4,153,461). However, the methods described above have more or less serious disadvantages. For example, in the treatment with alkali metal silicates, a certain deterioration in the shelf life has to be accepted.

Although the use of polyvinylphosphonic acid for the aftertreatment of the base leads to good printing characteristics of the printing plates, deposition of the polyvinylphosphonic acid (PVPA) on the base can lead to difficulties in production, such as the formation of an extremely poorly soluble precipitate as a result of reaction with $Al^{3+}$ ions, which leads to problems during use or to fragmentation of the layer during development or printing.

Furthermore, bases treated with PVPA tend to exhibit signs of aging when stored in the uncoated state. These are manifested in decreasing hydrophilicity and reduced developability of negative-working photosensitive layers which have been coated long after production of the base.

It is an object of the present invention to provide a class of compounds which, in the form of an intermediate layer between the base and the copying layer, increases the hydrophilicity of the nonimage areas without having an adverse effect on the adhesion of the radiation sensitive layer to the base and thus avoids or restricts the abovementioned disadvantages of known treatment agents.

It is known that silanes can be used as adhesion promoting or coupling compounds, particularly when it is intended to ensure adhesion of a plastic (cf. for example Lieng-Huang Lee, Adhesive Chemistry, Vol. 29, page 139 et seq.) or of an inorganic compound, e.g. gypsum (U.S. Pat. No. 3,382,083) to glass surfaces or glass fibers. However, silanes are also used as adhesion promoters in "dry offset printing plates". The "dry lithographic printing plate" is based on the principle of ensuring differentiation between printing and nonprinting parts by means of a photosensitive polymer layer which accepts the ink and an oleophobic silicone rubber layer which repels oily ink and is thus non-printing. For this purpose, for example, a photosensitive polymer layer is applied to a silicone rubber layer present on a metal base, exposed imagewise and developed so that, for example in the case of a negative-working plate, the silicone rubber layer is bared in the unexposed areas whereas in the exposed parts the polymer layer which has been cured by actinic radiation and is insoluble in the developer is formed. Since a silicone rubber having high ink repellency does not exhibit good adhesion to other materials, owing to its special properties, a silane coupling agent is used, this coupling agent acting as a contact adhesive between the base and the silicone rubber (cf. for example German Pat. Nos. 2,357,871 and 2,323,453).

It was therefore surprising that the novel aftertreatment of aluminum bases, pretreated according to the prior art, with an aqueous or alcoholic solution of a silane hydrolysis product or condensate, which solution is formed by hydrolysis of silanes, improves the hydrophilic properties of the base to such an extent that the nonimage areas of the imagewise exposed plate, after aqueous/alkaline development and application of an oily ink, showed no ink acceptance at all, without adversely affecting the adhesion of the photosensitive layer to the base. In the case of a photosensitive lithographic printing plate which can be developed with an aqueous/alkaline medium, the base not after treated according to the invention accepted ink in the nonimage areas too.

We have found that this object is achieved by a process for the production of a sensitized lithographic printing plate from an aluminum base which has been mechanically, chemically and/or electrochemically pretreated and anodically oxidized in a conventional manner and a photosensitive copying layer which is applied to this base, wherein a thin layer consisting of a hydrolysis product or condensate of one or more silanes is applied between the base and the copying layer. Silanes which are particularly suitable for use in hydrolysed or condensed form for the novel process are silanes of the general formula (I)

$$X-(CH_2)_y-Si(R^1)_n(OR^2)_{3-n} \quad (I)$$

where $R^1$ and $R^2$ are identical or different and are each alkyl of 1 to 9 carbon atoms or aryl of 6 to 12 carbon atoms, X is one of the radicals

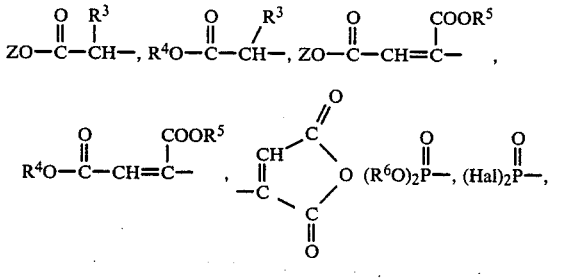

$ZO_3S-$, $HalO_2S-$, $ZO_3S-Ar-$ or $HalO_2S-Ar-$ where $R^{33}$ is hydrogen, alkyl of 1 to 9 carbon atoms, a carboxylic acid radical of 1 to 9 carbon atoms or a carboxylic anhydride ring formed from this carboxylic acid radical and the

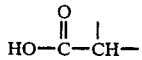

radical bonded to $R^3$, $R^4$ and $R^5$ are identical or different and are each alkyl of 1 to 9 carbon atoms or aryl of 6 to 12 carbon atoms, $R^6$ is hydrogen, alkyl of 1 to 9 carbon atoms or aryl of 6 to 12 carbon atoms, Z is hydrogen or an alkali metal, Ar is arylene of 6 to 12 carbon atoms, Hal is chlorine or bromine, y is an integer from 1 to 4 and n is 0, 1 or 2.

The silanes of the above formulae are used in hydrolysed or condensed form.

In the novel process, the hydrolysis product or condensate of the silane, in general in the form of its solution, is applied to the pretreated aluminum base by a conventional application method, such as spraying or immersion, any excess is removed and the coated base is dried at from 50° to 120° C.

The present invention furthermore relates to lithographic printing plates which are produced by the novel process, and to the use of these lithographic printing plates for offset printing.

The hydrolysis product or condensate of the silane

These solutions contain the hydrolysis product or condensate of the silane in general in amounts of from 0.05 to 30, preferably from 0.1 to 10, in particular from 0.5 to 3, % by weight. They can be prepared in a conventional manner by hydrolysis, if necessary acid-catalysed, from the parent silanes of the general formula (I).

The application of these solutions to the mechanically, ally, chemically and/or electrochemically pretreated and anodically oxidized aluminum base in a thin layer can be effected by a conventional application method, preferably by spraying or, in particular, by immersion of the base in the aqueous solution, at from 15° to 85° C., preferably from 25° to 60° C., for example for from 0.5 to 120, preferably from 10 to 60, seconds. Thereafter, excess solution can be removed by washing or spraying with water or alcohol, and the base after treated in this manner is dried at from 20° to 120° C., preferably from 50° to 110° C.

As stated above, silanes which are particularly suitable for the novel process are those of the general formula (I)

$$X-(CH_2)_y-Si(R^1)_n(OR^2)_{3-n} \quad (I)$$

where $R^1$ and $R^2$ are identical or different and are each alkyl of 1 to 9, preferably 1 to 4, carbon atoms, e.g. methyl, ethyl, propyl, isopropyl, butyl or isobutyl, or aryl of 6 to 12 carbon atoms, such as phenyl, benzyl or methylphenyl, X is one of the radicals

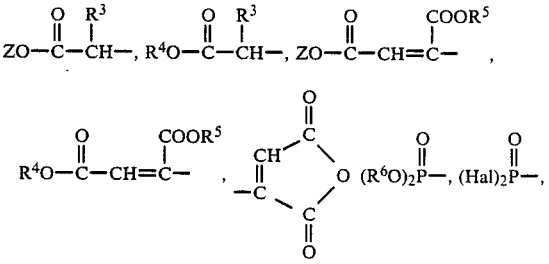

$ZO_3S-$, $HalO_2S-$, $ZO_3S-Ar-$ or $HalO_2S-Ar-$, $R^3$ is hydrogen, alkyl of 1 to 9, preferably 1 to 4, carbon atoms, e.g. methyl, ethyl, propyl or butyl, a carboxylic acid radical of 1 to 9, preferably 1 to 4, carbon atoms, e.g. —COOH, —$CH^2$COOH, —$C_2H_4$—COOH or $C_3H_6$—COOH, or a carboxylic anhydride ring formed from this carboxylic acid radical and the

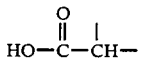

radical bonded to $R^3$, e.g. a succinic anhydride ring, $R^4$ and $R^5$ are identical or different and are each alkyl of 1 to 9, preferably 1 to 4, carbon atoms, e.g. methyl, ethyl, propyl or butyl, aryl of 6 to 12 carbon atoms, e.g. phenyl, benzyl or methylphenyl, $R^6$ is hydrogen, alkyl of 1 to 9, preferably 1 to 4, carbon atoms, e.g. methyl, ethyl, propyl or butyl, or aryl of 6 to 12 carbon atoms, e.g. phenyl, benzyl or methylphenyl, Z is hydrogen or an alkali metal, such as Li, Na or K, or $NH_4$, Ar is arylene of 6 to 12 carbon atoms, preferably phenylene, Hal is chlorine or bromine, preferably chlorine, y is an integer from 1 to 4, in particular 3, and n is 0, 1 or 2.

Examples of preferred silanes are (2-tripropoxysilylethyl)-carboxylic acid, (3-trimethoxysilylpropyl)carboxylic acid, (4-trimethoxysilylbutyl)-carboxylic acid and their methyl, ethyl, propyl and butyl esters, (3-triethoxysilylpropyl)-succinic anhydride, (3-triethoxysilylpropyl)-maleic anhydride, dimethyl (2-trimethoxysilylethyl)-phosphonate, dimethyl (3-triethoxysilylpropyl)phosphonate, diethyl (3-triethoxysilylpropyl)-phosphonate, (trimethoxysilylmethyl)-phosphonic acid dichloride, (3-trimethoxysilylpropyl)-phosphonic acid dichloride, (3-trimethoxysilylpropyl)-phosphonic acid, 2-(4-chlorosulfonylphenyl)-ethyltrimethoxysilane, 2-(4-sulfonylphenyl)-ethyltrimethoxysilane, (3-trimethoxysilylpropyl)-sulfonyl chloride and (3-trimethoxysilylpropyl)-sulfonic acid.

Particularly preferred silanes are (3-triethoxy-silylpropyl)-succinic anhydride, dimethyl (2-trimethoxysilylethyl)-phosphonate, diethyl (2-trimethoxysilylethyl)-phosphonate, dimethyl (3-trimethoxysilylpropyl)-phosphonate and diethyl (3-trimethoxysilylpropyl)-phosphonate.

The hydrolysis of such silanes can be carried out in a conventional manner in water or aqueous solutions of alcohols, in the presence or absence of acids. A certain amount of condensate formation may take place during the hydrolysis. Both hydrolysis products and condensates of the above silanes, as well as mixtures of these hydrolysis products and condensates, are suitable for the novel process provided that it is ensured that the hydrolysis products and condensates are completely dissolved or homogeneously dispersed in the aqueous or alcoholic solution.

The aluminum bases used for the novel process are mechanically, chemically and/or electrochemically pretreated and anodically oxidized in a conventional manner.

Pretreatment methods of this type are described in, for example, Wernick, Pinner, Zurbrugg and Weiner, Die Oberflachenbehandlung von Aluminium, Eugene G. Leuze Verlag, 1977.

After the novel treatment of the pretreated aluminum base with the solution of the hydrolysis product or condensate of the silane and drying of the thin layer, the aftertreated aluminum base is provided with the photosensitive copying layer in a conventional manner. This is a radiation-sensitive coating. Photopolymerizable mixtures which contain olefinically unsaturated compounds, such as monomers and/or oligomers, which can be photopolymerized in a conventional manner, some or all of which are polyolefinically unsaturated and, in the presence of photoinitiator systems, can be rapidly converted by exposure to actinic light to products which are sparingly soluble or insoluble in developers, are suitable for this purpose. The photopolymerizable olefinically unsaturated compounds which are known per se for UV-crosslinkable binders and for photopolymer printing plates are useful, the type and amount depending on the intended use of the mixtures and on any polymeric binders present, with which they should be compatible. In a preferred embodiment, this layer contains a photocrosslinkable polymer as a binder, a polyfunctional, ethylenically unsaturated monomer and a photoinitiator system consisting of one or more components, as well as conventional additives, such as suitable dyes, thermopolymerization inhibitors and plasticizers. The layer is then dried.

Examples of suitable polymers are methyl methacrylate/methacrylic acid copolymers, styrene/methacrylic acid copolymers and methacrylic acid/acrylic acid copolymers and, if required, also polyurethanes, unsaturated polyesters and/or polyesterurethanes.

Examples of suitable olefinically unsaturated compounds are di- and polyacrylates and -methacrylates, as can be prepared by esterification of diols or polyols with acrylic acid or methacrylic acid, e.g. the di- and tri(meth) acrylates of ethylene glycol, diethylene glycol, triethylene glycol, polyethylene glycol having a molecular weight of up to about 500, propane-1,2-diol, propane-1,3-diol, neopentyl glycol (2,2-dimethylpropanediol), butane-1,4-diol, 1,1,1-trimethylolpropane, glycerol or pentaerythritol; and the monoacrylates and monomethacrylates of such diols and polyols, e.g. ethylene glycol or di-, tri- or tetraethylene glycol monoacrylate, monomers containing two or more olefinically unsaturated bonds and urethane groups and/or amide groups, such as the low molecular weight compounds prepared from aliphatic diols of the abovementioned type, organic diisocyanates and hydroxyalkyl (meth)acrylates. Other examples are acrylic acid, methacrylic acid and their derivatives, such as (meth)acrylamide, N-hydroxymethyl(meth)acrylamide and (meth)acrylates of monoalcohols of 1 to 6 carbon atoms.

Suitable photoinitiators are the photoinitiators and photoinitiator systems conventionally used for photosensitive, photopolymerizable recording materials. Examples of these are benzoin, benzoin ethers, in particular benzoin alkyl ethers, substituted benzoins, alkyl ethers of substituted benzoins, e.g. alpha-methylbenzoin alkyl ethers or alpha-hydroxymethylbenzoin alkyl ethers; benzils, benzil ketals, in particular benzil dimethyl ketal, benzil methyl ethyl ketal or benzil methyl benzyl ketal; the acylphosphine oxide compounds which are known and effective photoinitiators, e.g. 2,4,6-trimethylbenzoyldiarylphosphine oxide; benzophenone, derivatives of benzophenone, 4,4'-dimethylaminobenzophenone, 4,4'-diethylaminobenzophenone, and derivatives of Michler's ketone; anthraquinone and substituted anthraquinones; aryl-substituted imidazoles and their derivatives, e.g. 2,4,5-triarylimidazoledimers; 2-chlorothioxanthone and the acridine or phenacine derivatives which are effective photoinitiators. Examples of initiator systems are combinations of the stated initiators with sensitizing agents or activators, in particular tertiary amines. Typical examples of such initiator systems are combinations of benzophenone or benzophenone derivatives with tertiary amines, such as triethanolamine or Michler's ketone, and mixtures of 2,4,5-triarylimidazoledimers and 2-mecaptobenzoquinazole or the leuco bases of triphenylmethane dyes. The choice of suitable photoinitiators or photoinitiator systems is familiar to the skilled worker. The photoinitiators or photoinitiator systems are present in the photopolymerizable recording layer in general in amounts of from 0.001 to 10, preferably from 0.05 to 5, % by weight, based on the photopolymerizable recording layer.

Examples of other additives and/or assistants which may be present in the photopolymerizable recording layer are thermal polymerization inhibitors, dyes and/or pigments, photochromic compounds or systems, sensitometric regulators, plasticizers, leveling agents, dulling agents, lubricants and the like. Examples of suitable thermal polymerization inhibitors are hydroquinone, hydroquinone derivatives, 2,6-di-tert-butyl-p-cresol, nitrophenols, N-nitrosamines, such as N-nitrosodiphenylamine, and the salts of N-nitrosocyclohexylhydroxylamine. Examples of dyes and/or pigments, which may serve both as contrast agents and for reinforcing the layer, include Brilliant Green Dye (C.I. 42,040), Victoria Sky Blue FGA, Victoria Sky Blue BO (C.I. 42,595), Victoria Blue B (C.I. 44,045), Rhodamine 6 G (C.I. 45,160), triphenylmethane dyes, naphthalimide dyes and 3'-phenyl-7-dimethylamino-2,2'-spiro-di-(2H-1-benzopyran). Photochromic systems which change their color reversibly or irreversibly when exposed to actinic light without adversely affecting the photopolymerization process are, for example, leuco dyes together with suitable activators. Examples of leuco dyes are the leuco bases of the triphenylmethane dyes, such as crystal violet leuco base and malachite green leuco base, leuco basic blue, leuco pararosaniline and leuco patent blue A or V; Rhodamine B base is also suitable. Suitable activators for these photochromic compounds include organic halogen compounds which eliminate halogen radicals when exposed to actinic light, or hexaarylbisimidazoles. The sensitometric regulators include compounds such as 9-nitroanthracene, 10,10'-bisanthrone, and phenazinium, phenoxazinium, acridinium and phenothiazinium dyes, in particular in combination with mild reducing agents, 1,3-dinitrobenzenes and the like. Suitable plasticizers are the conventional low molecular weight or high molecular weight esters, such as phthalates or adipates, toluenesulfonamide or tricresyl phosphate. The photopolymerizable recording layers contain the additives and/or assistants in the effective amounts conventionally used for these substances.

In addition to the photosensitive substances, the copying layers can of course also contain other components. In particular, the following photosensitive materials or compounds may be employed in coating the bases: positive-working reproduction layers containing o-quinonediazides, in particular o-naphthoquinonediazides, such as naphthoquinone-1,2-diazide-2-sulfonates or -amides, which may be high molecular weight or low molecular weight, as photosensitive compounds; negative-working reproduction layers containing cocondensates of aromatic diazonium salts and compounds possessing active carbonyl groups;

negative-working reproduction layers containing cocondensates of aromatic diazonium compounds, the said reproduction layers containing products with one or more units of a condensable aromatic diazonium salt and one or more units of a condensable compound, such as a phenol ether or an aromatic thioether, bonded by a divalent bridging member derived from a condensable carbonyl compound, such as a methylene group;

positive-working layers which contain a compound which eliminates an acid on exposure, a monomeric or polymeric compound which possesses one or more C—0—C groups which can be eliminated by means of an acid (for example an orthocarboxylate group or a carboxamidoacetal group) and, if required, a binder;

and negative-working layers which contain a diazonium salt polycondensate or an organic azido compound as the photosensitive compound and a high molecular weight polymer possessing alkenylsulfonyl or cycloalkenylsulfonylurethane side groups as the binder.

The coated offset printing plates obtained from the bases after treated according to the invention are converted to the desired printing plate in a conventional manner by imagewise exposure or irradiation and washing out of the nonimage areas with a developer, preferably an aqueous developer.

The radiation-sensitive layer can thus contain diazonium compounds, conventional polymeric condensates, quinonediazides or photopolymers. Photopolymers, in particular the reaction product from the polymerization of methyl methacrylate and methacrylic acid, as binders and ethylenically unsaturated monomers, in particular butanediol diglycidyl diacrylate, as a crosslinking component are preferred.

The novel process makes it possible to functionalize the base surface in a manner relating to the particular problem (increase in the hydrophilicity of the base, increase in the adhesion of the polymer), by using a very wide variety of functional groups, these being bonded to the hydrolysed silane as radicals X. The firm bonding of the silane hydrolysis product to the base on the one hand ensures that the printing plate has the necessary shelf life, since destruction of the photosensitive layer by diffusion of the aftertreatment substance into the layer is prevented, this process being possible in other aftertreatment processes, and on the other hand ensures long print runs, since this intermediate layer adheres firmly to the surface during printing.

The Examples which follow illustrate the invention.

In the Examples and Comparative Examples, parts and percentages are by weight, unless stated otherwise.

Test for suitability for offset printing: The plates produced were investigated by wiping the ready prepared printing plate with a fatty printing ink conventionally used in the printing industry, the ratings in the inking test having the following meanings:

A=can be washed completely clean, no ink acceptance in nonimage areas, suitable for difficult applications in offset printing;

B=slightly shaded or mottled, slight ink acceptance, still suitable for offset printing;

C=pronounced shading, unsuitable for offset printing.

The ratings relate in each case to the nonprinting areas of the printing plate.

COMPARATIVE EXAMPLE 1

An aluminium sheet roughened electrochemically by treatment with a.c. current in aqueous HCl and $HNO_3$ solution and anodically oxidized in sulfuric acid is coated with a photosensitive mixture so that the layer weight is 2 g/m$^2$.

The photosensitive mixture has the following composition:

59% of binder (copolymer of methyl methacrylate and methacrylic acid), 30% of a monomer (diacrylate of 1,4-butanediol glycidyl ether), 2% of Michler's ketone 6% of 2-(4'-methoxynaphth-1'-yl)-4,6-bis-(trichloromethyl)-s-triazine, 1% of bromophenol blue and 2% of a plasticizer (benzenesulfonic acid n-butylamide).

The base coated in this manner is exposed under a mercury vapor lamp through a test transparency and developed with an aqueous alkaline developer. The plate produced in this manner is then inked with printing ink.

Test result:

Rating: C

COMPARATIVE EXAMPLE 2

An aluminium sheet electrochemically roughened by treatment with a.c. current in aqueous HCl and $HNO_3$ solution and anodically oxidized in phosphoric acid is coated, exposed imagewise, developed and inked, these tests being carried out in the manner described in Comparative Example 1.

Test result:

Rating: C

EXAMPLE 1

A 3% strength aqueous solution of the corresponding silane hydrolysis product is prepared by hydrolysis of (3-triethoxysilylpropyl)-succinic anhydride in water. An aluminum sheet pretreated electrochemically as in Comparative Example 1 and anodically oxidized in sulfuric acid is immersed in this solution at 60° C. for 60 seconds, washed thoroughly with water and then dried at 80° C.

The plate aftertreated in this manner is then coated, exposed imagewise, developed and inked, these steps being carried out as described in Comparative Example 1.

Test result:
Rating: B

EXAMPLE 2

A printing plate aftertreated and coated as described in Example 1 is stored for 30 days at 50° C. and then processed in a conventional manner.

Test result:

Rating: B

EXAMPLE 3

The procedure described in Example 1 is followed, except that an aluminum sheet anodically oxidized in phosphoric acid is used, as described in Comparative Example 2.

Test result:

Rating: B

EXAMPLE 4

A printing plate aftertreated and coated as described in Example 3 is stored for 30 days at 50° C. and then processed in a conventional manner.

Test result:

Rating: B

EXAMPLE 5

An aluminum sheet as described in Comparative Example 1 and anodically oxidized in sulfuric acid is processed according to Example 1, except that the temperature of the 3% strength solution of the silane hydrolysis product is 25° C.

Test result:
Rating: A

EXAMPLE 6

A printing plate produced as described in Example is first stored for 30 days at 50° C. and then processed in a conventional manner.

Test result:
Rating: A

EXAMPLE 7

An aluminum sheet as described in Comparative Example 2 and anodically oxidized in phosphoric acid is processed according to Example 1, except that the temperature of the 3% strength solution of the silane hydrolysis product is 25° C.

Test result:
Rating: A

EXAMPLE 8

A printing plate produced as described in Example 7 is first stored for 30 days at 50° C. and then processed in a conventional manner.

Test result:
Rating: A

EXAMPLE 9

An aluminum sheet as described in Comparative Example 1 and anodically oxidized in sulfuric acid is processed according to Example 1, except that aftertreatment is effected by immersion at 25° C. in a 1% strength solution of a silane hydrolysis product.

Test result:
Rating: A

EXAMPLE 10

A printing plate produced as described in Example 9 is stored for 30 days at 50° C. and then processed in a conventional manner.

Test result:
Rating: A

EXAMPLE 11

An aluminum sheet as described in Comparative Example 2 and anodically oxidized in phosphoric acid is processed according to Example 1, except that aftertreatment is effected by immersion at 25° C. in a 1% strength solution of a silane hydrolysis product.

Test result:
Rating: A

The printing plate produced in this manner is also tested on a printing press (Heidelberg GTO). In spite of several interruptions and dry running, it gave 130,000 satisfactory prints without the nonimage areas accepting printing ink.

EXAMPLE 12

A printing plate produced as described in Example 11 is stored for 30 days at 50° C. and then processed in a conventional manner.

Test result:
Rating: A

EXAMPLE 13

Dimethyl (2-trimethoxysilylethyl)phosphonate is hydrolysed in concentrated hydrochloric acid as described in U.S. Pat. Nos. 3,780,127 and 3,816,550. After removal of excess hydrochloric acid, the product obtained in this manner is used to prepare a 3% aqueous solution.

The procedure described in Example 1 is then followed.

Test result:
Rating: A

EXAMPLE 14

A printing plate produced as described in Example 13 is stored for 30 days at 50° C. and then processed in a conventional manner.

Test result:
Rating: A

EXAMPLE 15

The procedure described in Example 13 is followed, except that an aluminum sheet anodically oxidized in phosphoric acid is employed, as described in Comparative Example 2.

Test result:
Rating: A

EXAMPLE 16

A printing plate produced as described in Example 15 is stored for 30 days at 50° C. and then processed in a conventional manner.

Test result:

Rating: A

EXAMPLE 17

The procedure described in Example 15 is followed, except that the aftertreatment is carried out for 60 seconds at a bath temperature of 25° C.

Test result:

Rating: A

EXAMPLE 18

A printing plate produced as described in Example 17 is stored for 30 days at 50° C. and then processed in a conventional manner.

Test result:

Rating: A

EXAMPLE 19

The procedure described in Example 13 is followed, except that the aftertreatment is carried out for 60 seconds at a bath temperature of 25° C.

Test result:

Rating: A

EXAMPLE 20

A printing plate produced as described in Example 19 is stored for 30 days at 50° C. and then processed in a conventional manner.

Test result:

Rating: A

EXAMPLE 21

The procedure described in Example 13 is followed, except that the aftertreatment bath contains 1% by weight of hydrolysed or condensed silane. The aftertreatment is carried out at 25° C. for 60 seconds.

Test result:

Rating: A

EXAMPLE 22

A printing plate produced as described in Example 21 is stored for 30 days at 50° C. and then processed in a conventional manner.

Test result:

Rating: A

EXAMPLE 23

The procedure described in Example 21 is followed, except that an aluminum sheet as described in Comparative Example 2 and anodically oxidized in phosphoric acid is processed.

Test result:

Rating: A

The printing plate produced in this manner is additionally tested on a printing press (Heidelberg GTO). In spite of several interruptions and dry running, it gives about 180,000 satisfactory prints without the nonimage areas accepting ink.

EXAMPLE 24

A printing plate produced as described in Example 23 is stored for 30 days at 50° C. and then processed in a conventional manner.

Test result:

Rating: A

We claim:

1. An improved light sensitive element for use in preparing an offset printing plate by imagewise exposure comprising an aluminum base which has been pretreated and anodically oxidized, a positive- or negative-working light sensitive layer and an intermediate layer between said aluminum base and said light sensitive layer, the improvement comprising an intermediate layer which consists essentially of a silane hydrolysis product, condensate or mixtures thereof which has hydrophilic properties, said silane being selected from compounds of the formula (I)

$$X-(CH_2)_y-Si(R^1)_n(OR^2)_{3-n} \quad (I)$$

where $R^1$ and $R^2$ are identical or different and are each alkyl of 1 to 9 carbon atoms or aryl of 6 to 12 carbon atoms; and X is one of the radicals

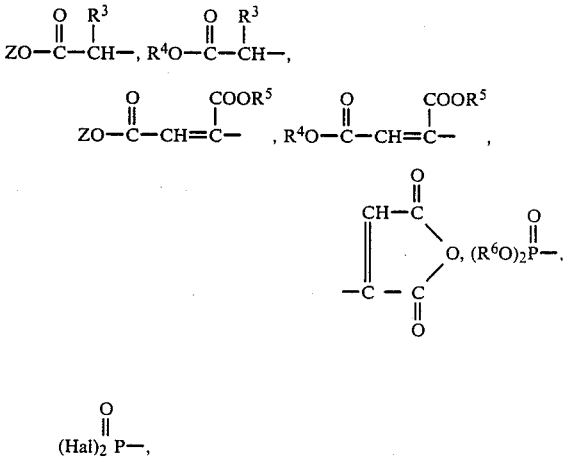

$(Hal)_2P-$, $ZO_3S-$, $HalO_2S-$, $ZO_3S-Ar-$ or $HalO_2S-Ar-$;

where $R^3$ is hydrogen, alkyl of 1 to 9 carbon atoms; a carboxylic acid radical of 1 to 9 carbon atoms or a carboxylic anhydride ring formed from said carboxylic acid radical and the

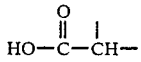

radical bonded to $R^3$; $R^4$ and $R^5$ are identical or different and are each alkyl of 1 to 9 carbon atoms or aryl of 6 to 12 carbon atoms; $R^6$ is hydrogen, alkyl of 1 to 9 carbon atoms or aryl of 6 to 12 carbon atoms; Z is hydrogen or an alkali metal; Ar is arylene of 6 to 12 carbon atoms; Hal is chlorine or bromine; y is an integer from 1 to 4 and n is 0, 1 or 2.

2. The light sensitive element of claim 1, wherein said intermediate layer is formed by coating the pretreated aluminum base with a solution of the silane hydrolysis product, condensate or mixture thereof, removing any excess solution and drying the coated base at from 50° to 120° C.

3. The light sensitive element of claim 2, wherein the coating of the base is carried out at from 15° to 85° C. in the course of from 0.5 to 120 seconds with a 0.05 to 30% strength by weight of an aqueous or alcoholic solution of the silane hydrolysis product, condensate or mixture thereof.

4. The light sensitive element of claim 1, wherein (3-triethoxysilylpropyl)-succinic anhydride or dimethyl (2-trimethoxysilylethyl) phosphate in the hydrolysed or condensed form or in the form of a mixture of a hydrolysis product and a condensate is used as the silane.

* * * * *

UNITED STATES PATENT AND TRADEMARK OFFICE

CERTIFICATE OF CORRECTION

PATENT NO. : 4,935,332

DATED : June 19, 1990

INVENTOR(S) : Harald LAUKE et al.

It is certified that error appears in the above-identified patent and that said Letters Patent is hereby corrected as shown below:

Claim 4, Column 12, Line 65

"phosphate" should read --phosphonate--

Signed and Sealed this

Twentieth Day of August, 1991

*Attest:*

*Attesting Officer*

HARRY F. MANBECK, JR.

*Commissioner of Patents and Trademarks*